US005357735A

United States Patent [19]

Fry

[11] Patent Number: 5,357,735

[45] Date of Patent: Oct. 25, 1994

[54] ADJUSTABLE HORSE BIT

[76] Inventor: Donald G. Fry, 3766 Sankey Rd., Pleasant Grove, Calif. 95668

[21] Appl. No.: 110,779

[22] Filed: Aug. 23, 1993

[51] Int. Cl.[5] ..... B68B 1/06

[52] U.S. Cl. ..... 54/9

[58] Field of Search ..... 54/7, 8, 9

[56] References Cited

U.S. PATENT DOCUMENTS 264,925 9/1882 Cahoone ..... 54/8
492,666 2/1893 Driscoll ..... 54/8
799,602 9/1905 Johnson ..... 54/8
4,965,987 10/1990 Bork ..... 54/7

*Primary Examiner*—Robert P. Swiatek
*Attorney, Agent, or Firm*—Gary Alan Culliss

[57] ABSTRACT

A horse bit which may be adjusted to fit various widths of horses' mouths. The adjustable bit includes a mouth piece having an adjustment assembly which may be elongated or abbreviated to an appropriate width for insertion into a mouth of a particular horse. The adjustable horse bit is illustrated in both curb bit and snaffle bit styles.

2 Claims, 4 Drawing Sheets

*FIG. 1*
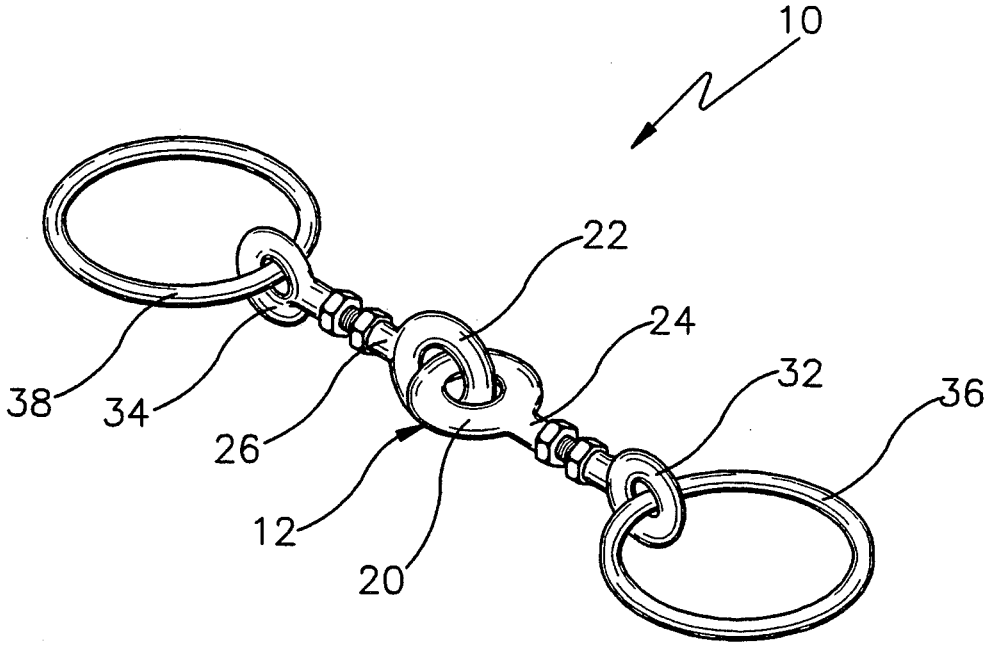
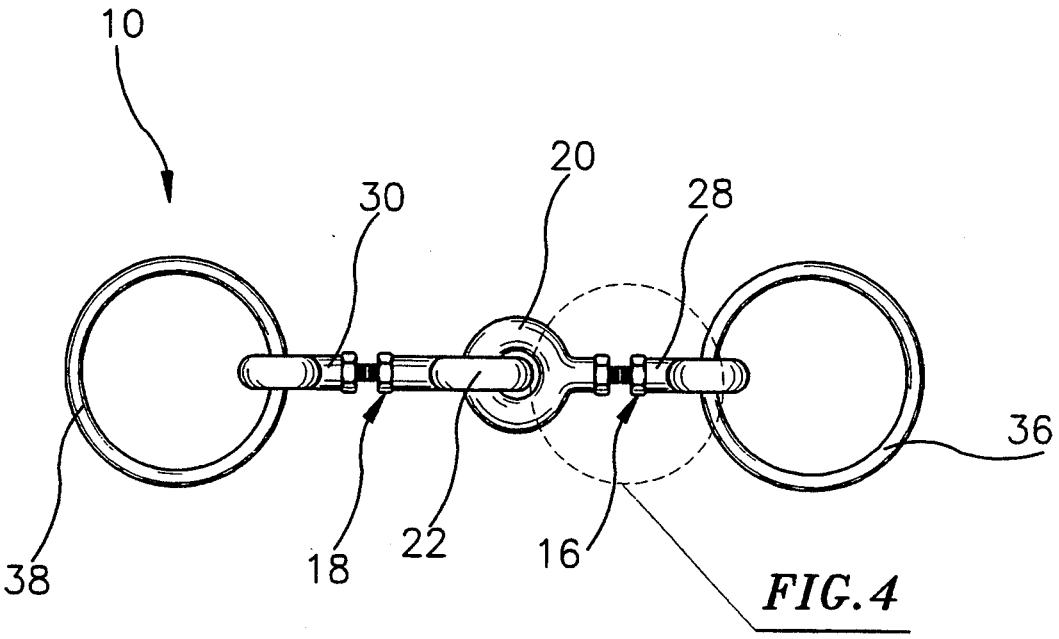
*FIG. 2*

FIG. 3
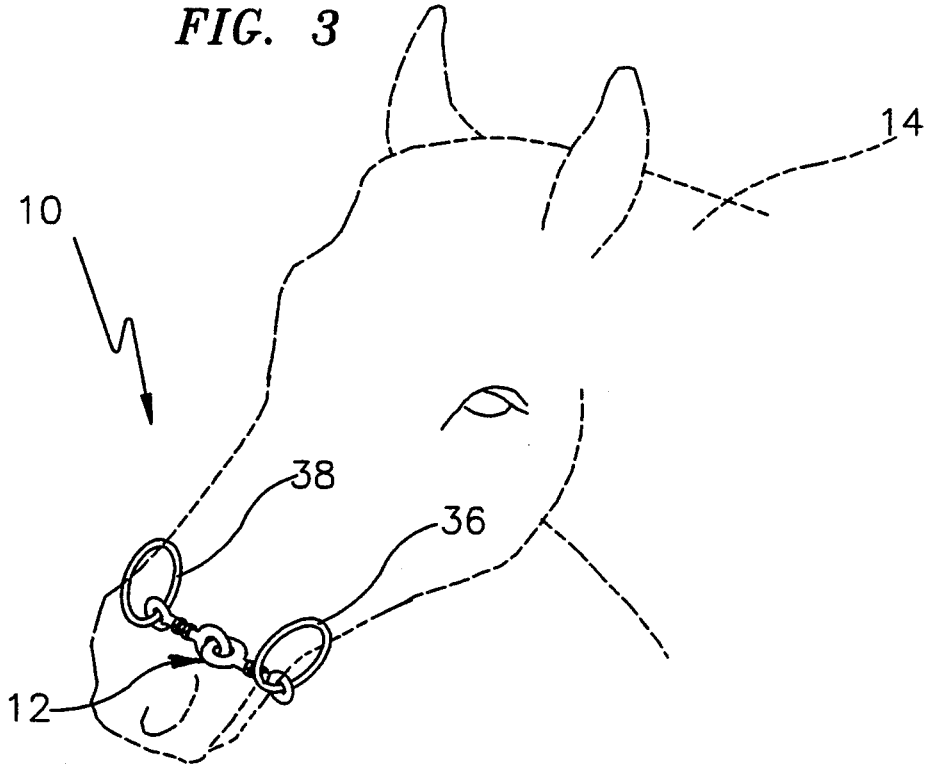
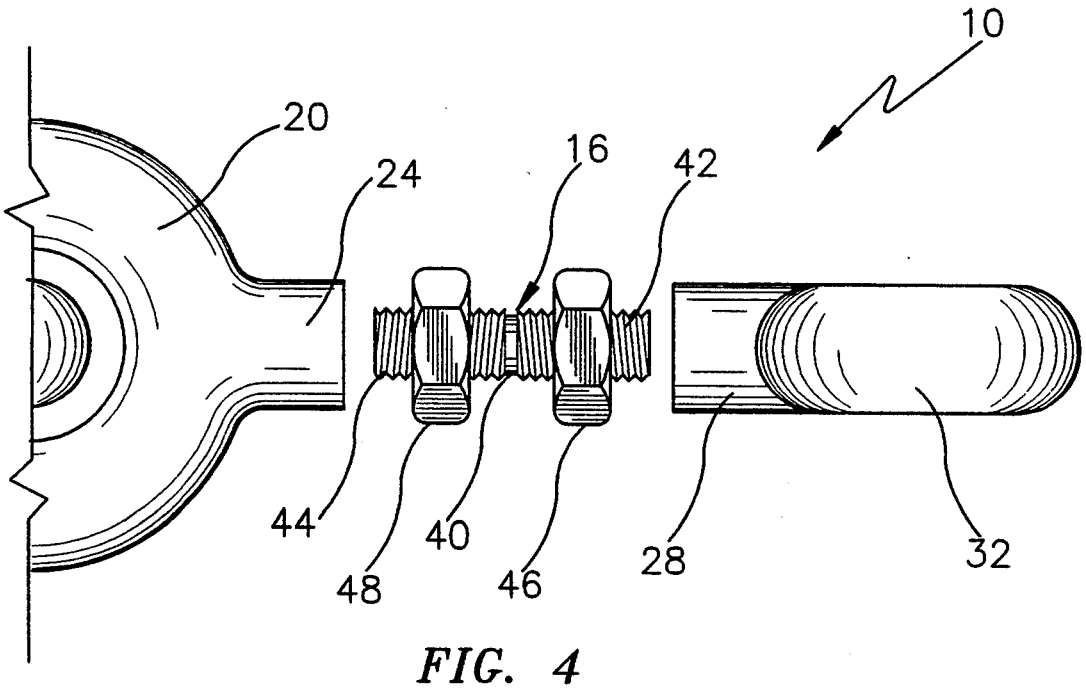
FIG. 4

ADJUSTABLE HORSE BIT

BACKGROUND OF THE INVENTION

1. Field of the Invention

The present invention relates to horse bits and more particularly pertains to adjustable horse bits which may be adjusted to fit into horses' mouths of various widths.

2. Description of the Prior Art

The use of horse bits is known in the prior art. More specifically, horse bits heretofore devised and utilized for the purpose of controlling a horse are known to consist basically of familiar, expected and obvious structural configurations, notwithstanding the myriad of designs encompassed by the crowded prior art which have been developed for the fulfillment of countless objectives and requirements.

For example, an adjustable curb bit is illustrated in U.S. Pat. No. 3,478,493 which utilizes adjustable rein levers. Each lever is formed as a tubular arm and a rod, carrying a rein eye, slidably extensible from the arm and may be secured in a desired position by a collet type lock which is tightened by a lock nut at the end of the arm.

A horse tack bit is described in U.S. Pat. No. 4,745,733 in which a tensioning of the reins in one direction will cause a flexion of the bit, thereby turning the head of an animal wearing the bit in the opposite direction of the tension.

Another patent of interest is U.S. Pat. No. 4,884,390 which discloses a bridle bit for horses comprising a mouthpiece to be received in the mouth of a horse in which the mouthpiece members move independently of one another, the head stall and cheek piece rotate about their longitudinal axis as a unit relative to the mouthpiece members, and the rein ring members rotate about their longitudinal axis relative to the mouthpiece members and the cheek piece members.

While these devices fulfill their respective, particular objectives and requirements, the aforementioned patents do not describe an adjustable horse bit which may be adjusted to fit into various widths of horses' mouths.

In this respect, the adjustable horse bit according to the present invention substantially departs from the conventional concepts and designs of the prior art, and in so doing provides an apparatus which may be adjusted to fit into horses' mouths of differing widths.

SUMMARY OF THE INVENTION

In view of the foregoing disadvantages inherent in the known types of horse bits now present in the prior art, the present invention provides a new adjustable horse bit construction wherein the same can be utilized for facilitating an adjustment of the width of the bit to accommodate different mouth sizes. As such, the general purpose of the present invention, which will be described subsequently in greater detail, is to provide a new adjustable horse bit apparatus which has many of the advantages of the horse bits mentioned heretofore and many novel features that result in a adjustable horse bit which is not anticipated, rendered obvious, suggested, or even implied by any of the prior art horse bits, either alone or in any combination thereof.

To attain this, the present invention essentially comprises a horse bit which may be adjusted to fit various widths of horses' mouths. The adjustable bit includes a mouth piece having an adjustment assembly which may be elongated or abbreviated to an appropriate width for insertion into a mouth of a particular horse. The adjustable horse bit is disclosed in both curb bit and snaffle bit styles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable horse bit apparatus which has many of the advantages of the horse bits mentioned heretofore and many novel features that result in a adjustable horse bit which is not anticipated, rendered obvious, suggested, or even implied by any of the prior art horse bits, either alone or in any combination thereof.

It is another object of the present invention to provide a new adjustable horse bit which may be easily and efficiently manufactured and marketed.

It is a further object of the present invention to provide a new adjustable horse bit which is of a durable and reliable construction.

An even further object of the present invention is to provide a new adjustable horse bit which is susceptible of a low cost of manufacture with regard to both materials and labor, and which accordingly is then susceptible of low prices of sale to the consuming public, thereby making such adjustable horse bits economically available to the buying public.

Still yet another object of the present invention is to provide a new adjustable horse bit which provides in the apparatuses and methods of the prior art some of the advantages thereof, while simultaneously overcoming some of the disadvantages normally associated therewith.

Still another object of the present invention is to provide a new adjustable horse bit which may be adjusted to fit into various widths of horses' mouths.

Yet another object of the present invention is to provide a new adjustable horse bit having an adjustment assembly which may be elongated or abbreviated to an appropriate width for insertion into a mouth of a particular horse.

Even still another object of the present invention is to provide a new adjustable horse bit which includes features of both a curb and a snaffle style bit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a first embodiment of an adjustable horse bit comprising the present invention.

FIG. 2 is a top plan view of the present invention.

FIG. 3 is a perspective view of the invention positioned in a mouth of a horse.

FIG. 4 is an enlarged, exploded view of a portion of the present invention.

DESCRIPTION OF THE PREFERRED EMBODIMENT

Figure 5:
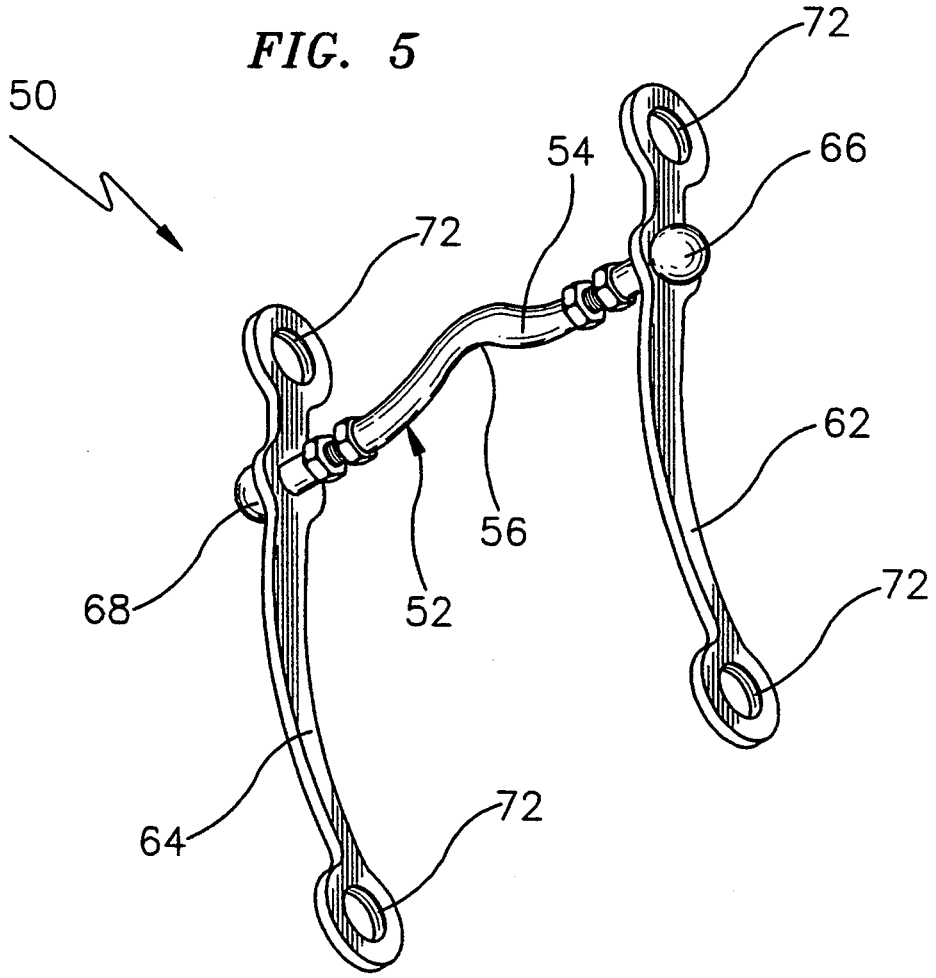
FIG. 5 is a perspective view of a second embodiment of the present invention.
Figure 6:
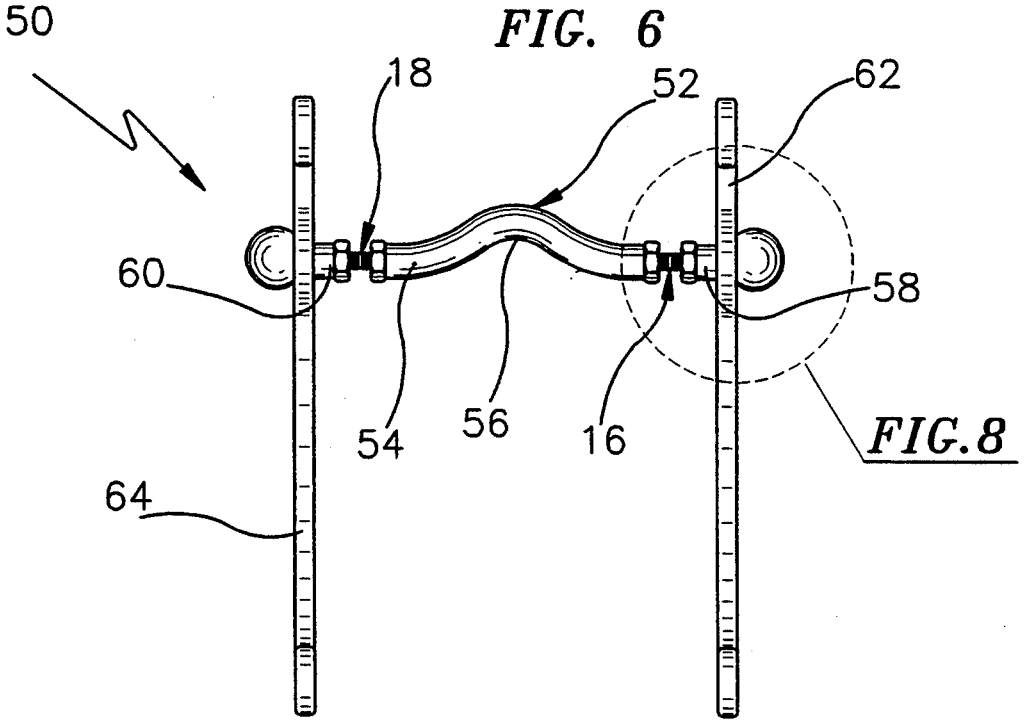
FIG. 6 is a front elevation view thereof.
Figure 7:
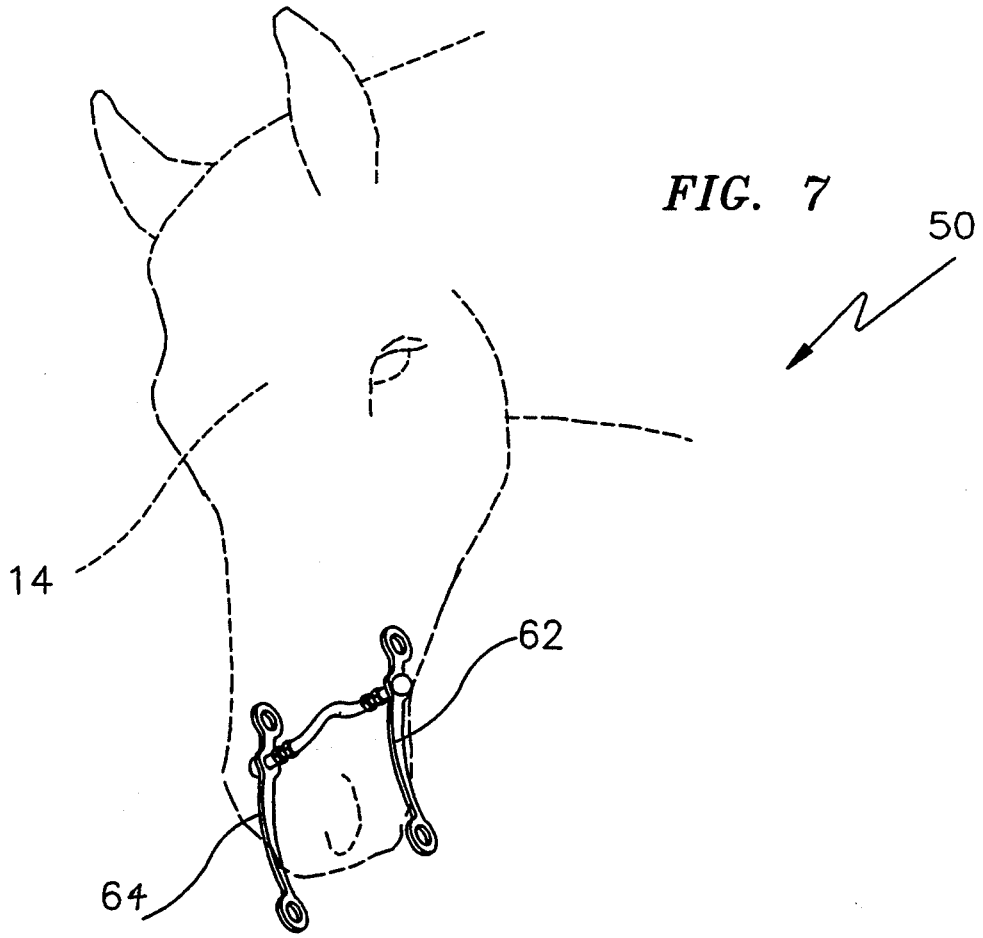
FIG. 7 is a perspective view of the second embodiment positioned within a mouth of a horse.

With reference now to the drawings, and in particular to FIGS. 1–4 thereof, a new adjustable horse bit embodying the principles and concepts of the present invention and generally designated by the reference numeral 10 will be described.

The adjustable horse bit 10 comprises a mouthpiece 12 which may be inserted into a mouth of a horse 14, as depicted in FIG. 3. Threadably connected to respectively opposed ends of the mouthpiece 12 are a pair of bit adjustment assemblies 16, 18 which allow a width of the mouthpiece to be adjusted thereby. The bit adjustment assemblies 16, 18 allow the mouthpiece 12 to be adjusted to fit into narrow mouths, wide mouths, and various widths therebetween. The adjustable horse bit 10 may be adjusted to provide an appropriate fit within a mouth of any particular animal and re-adjusted as the animal grows.

More specifically, it will be noted that the adjustable horse bit 10 comprises a pair of center eyelets 20, 22 which are interlocked together as shown in FIG. 1. A pair of center shanks 24, 26 are fixedly secured to respective center eyelets 20, 22 and are each provided with unillustrated threaded apertures therein. The bit adjustment assemblies 16, 18 are received within the threaded apertures of the center shanks 24, 26, respectively, and are further received within unillustrated threaded apertures present in a pair of outer shanks 28, 30, as illustrated in FIG. 2. The outer shanks 28, 30 are integrally or otherwise connected to a pair of outer eyelets 32, 34 which are operable to capture a pair of strap anchors, illustrated in the first embodiment as bridle rings 36, 38, therein, respectively. The bridle rings 36, 38 are substantially 0-shaped, but it is within the intent and purview of present invention to include bridle rings of various shapes, including such bridle rings which are D-shaped.

The bit adjustment assemblies 16, 18 are substantially identical in function and design and therefore only one bit adjustment assembly 16 will be described in detail. FIG. 4 illustrates the bit adjustment assembly 16 and it can be seen from this drawing that the bit adjustment assembly comprises a rod 40 which includes both threads having a first direction 42 and threads having a second direction 44 integrally present thereon at respectively opposed ends. A pair of nuts 46, 48, having appropriate unillustrated threads present therein, are engaged to the threads having a first direction 42 and the threads having a second direction 44 of the rod 40, respectively. The bit adjustment assembly 16 serves to connect the center shank 24 of the mouthpiece 12 to the outer shank 28 of the outer eyelet 32 and may be adjusted to change the distance between the center shank and the outer shank, thereby varying a width of the horse bit 10. The nuts 46, 48 may be utilized to secure the bit adjustment assembly 16 in an appropriate position.

Figure 8:
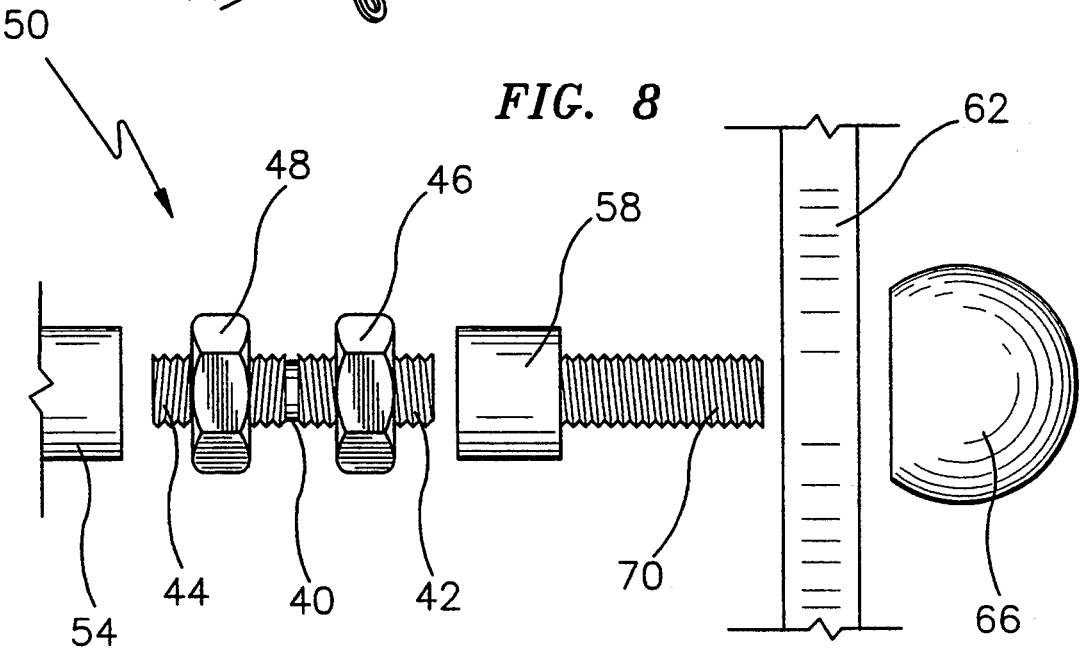
FIG. 8 is an enlarged, exploded view of a portion of the second embodiment.

A second embodiment of the present invention as generally designated by the reference numeral 50 is illustrated in FIGS. 5–8. The second embodiment 50 is comprised of a mouthpiece 52 having a center shank 54 which includes an offset port area 56 integrally present therein. The center shank 54 includes threaded apertures at respectively opposed ends thereof which are operable to receive a portion of the bit adjustment assemblies 16, 18. A pair of connectors 58, 60, also having threaded apertures therein, are engaged to the bit adjustment assemblies 16, 18, respectively, as best shown in FIG. 8. A pair of strap anchors, illustrated in the second embodiment as a pair of side arms 62, 64, are captured upon respective connectors 58, 60 by a pair of spherical nuts 66, 68 which engage threads 70 present on each of the connectors as illustrated for one of such connectors 58 in FIG. 8. Each of the side arms 62, 64 has a plurality of apertures 72 therethrough which facilitate a connection of reins and other straps to the adjustable horse bit 50.

The bit adjustment assemblies 16, 18 of the second embodiment 50 are substantially identical to those present in the first embodiment 10. The horse bit 50 may be adjusted through a rotation of the bit adjustment assembly 16 to accommodate various widths of horses' mouths. An appropriate position may be secured by a tightening of the nuts 46, 48 in a well understood manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable horse bit comprising:

a mouthpiece positionable within a mouth of an animal, said mouthpiece having respectively opposed ends thereof;

a pair of strap anchors coupled to said mouthpiece;

at least one adjustment means coupled to said mouthpiece to vary a width thereof, said at least one adjustment means comprising a pair of threaded rods, each of said pair of threaded rods being threadably engaged to one of said respectively opposed ends of said mouthpiece and to one of said pair of strap anchors; and, at least one nut threadably engaged to at least one of said pair of threaded rods for securing an angular position of said at least one of said pair of threaded rods.

2. An adjustable horse bit comprising:

a mouthpiece positionable within a mouth of an animal, said mouthpiece having respectively opposed ends thereof, said mouthpiece comprising a pair of center shanks, with each shank having a center eyelet secured thereto, said eyelets being interlocked to pivotally couple said shanks together;

a pair of strap anchors coupled to said mouthpiece;

at least one adjustment means coupled to said mouthpiece to vary a width thereof, said at least one adjustment means comprising a pair of threaded rods, each of said pair of threaded rods being threadably engaged to one of said respectively opposed ends of said mouthpiece and to one of said pair of strap anchors; and at least one nut threadably engaged to at least one of said pair of threaded rods for securing an angular position of said at least one of said pair of threaded rods.

* * * * *